United States Patent [19]

Hundertmark et al.

[11] 4,285,308

[45] Aug. 25, 1981

[54] COLD START FUEL ENRICHMENT SYSTEM

[75] Inventors: James M. Hundertmark, Fond du Lac; James L. Wagner, Butte des Morts, both of Wis.

[73] Assignee: Brunswick Corporation, Skokie, Ill.

[21] Appl. No.: 38,599

[22] Filed: May 14, 1979

[51] Int. Cl.[3] ..... F02M 1/16

[52] U.S. Cl. ..... 123/187.5 R; 123/580

[58] Field of Search ..... 123/179 G, 127, 187.5, 123/579, 581; 261/39 D, 71, 23 A, DIG. 8

[56] References Cited

U.S. PATENT DOCUMENTS

| | | | |
|---|---|---|---|
| 995,201 | 6/1911 | Stowe | 123/187.5 |
| 1,164,930 | 12/1915 | Clairmont | 216/DIG. 8 |
| 1,463,712 | 7/1923 | Mead | 123/179 G |
| 1,474,219 | 11/1923 | Watson | 123/187.5 |
| 1,699,224 | 1/1929 | Bracke | 261/DIG. 8 |
| 1,735,635 | 11/1929 | Bragg | 123/579 |
| 2,051,351 | 8/1936 | Speed | 123/579 |
| 2,075,330 | 3/1937 | Angell | 123/579 |
| 2,163,241 | 6/1939 | Huber | 123/581 |
| 2,460,046 | 1/1949 | Vincent | 123/579 |
| 2,516,787 | 7/1950 | Moody | 123/187.5 |
| 3,035,601 | 5/1962 | Moseley | 123/579 |
| 3,614,945 | 10/1971 | Schlagmuller | 123/179 G |
| 3,888,223 | 6/1975 | Mondt | 123/179 G |
| 4,191,716 | 3/1980 | Yamashita | 261/39 D |

FOREIGN PATENT DOCUMENTS

| | | | |
|---|---|---|---|
| 179466 | 9/1917 | Canada | 123/187.5 R |

*Primary Examiner*—Ronald H. Lazarus

*Attorney, Agent, or Firm*—O. Thomas Sessions

[57] ABSTRACT

A cold start fuel enrichment system for an internal combustion engine uses fuel from the upper carburetor for enriching the air-fuel mixture in the lower carburetors by gravity feed. A fuel line runs from the upper carburetor float bowl to the throttle bores of the lower carburetor. A solenoid valve in the fuel line controls its operation.

10 Claims, 1 Drawing Figure

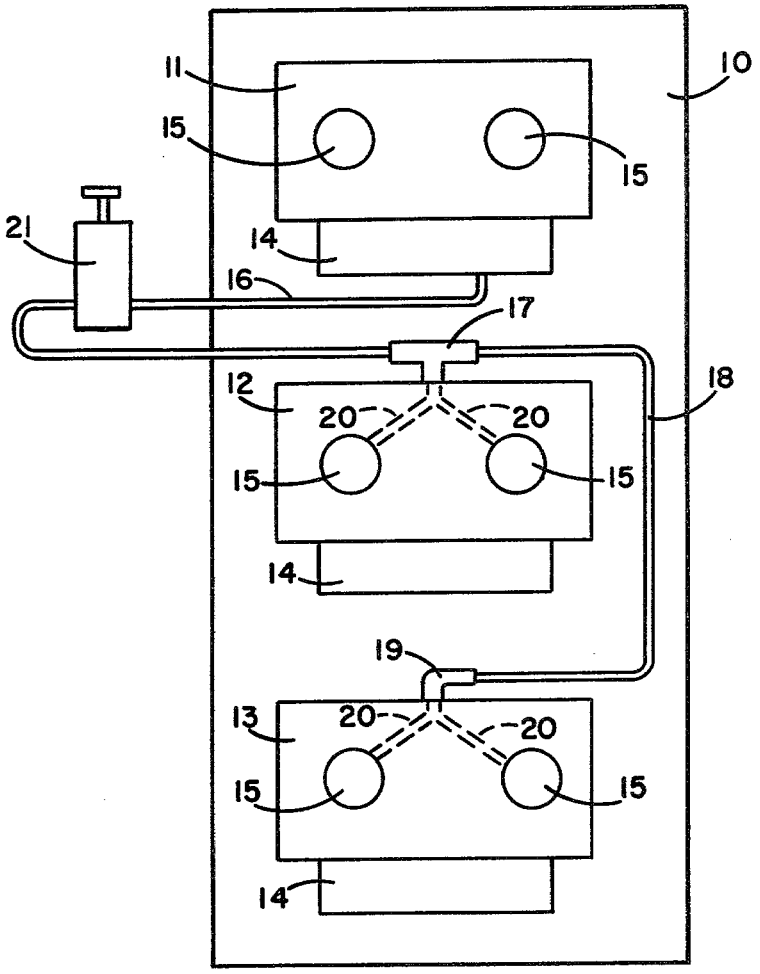
10
11
15
15
21
14
16
17
18
12
20
20
15
15
14
19
13
20
20
15
15
14

COLD START FUEL ENRICHMENT SYSTEM

BACKGROUND OF THE INVENTION

This invention relates to a carburetion system for an internal combustion engine and particularly to a fuel enrichment system for use during cold starting of the engine.

Prior cold start systems have used a variety of mechanical choke systems and fuel addition systems to enrich the air-fuel mixture for cold starting of internal combustion engines. These systems suffer from the problems of mechanical complexity and the capability of flooding the engine, thus preventing its starting.

SUMMARY OF THE INVENTION

The inventors have discovered that a fuel reservoir placed above an engine air induction tube can be used to supply fuel by gravity feed through a valved passage to the engine air induction tube to enrichen the air-fuel ratio for cold starting. More than one induction tube can be enrichened and the fuel reservoir can be the float bowl of an upper carburetor.

BRIEF DESCRIPTION OF THE DRAWING

The FIGURE is a schematic view in elevation of an engine fuel enrichment system in accordance with the invention.

DESCRIPTION OF THE PREFERRED EMBODIMENT

The drawing schematically shows a fuel system for a two cycle, vertical crankshaft, internal combustion engine 10. Mounted on the engine in a conventional manner are three two-barrel carburetors, 11, 12, and 13. Each carburetor has a float bowl 14 and two air induction passages or barrels 15 and operates in a conventional manner as part of the engine air induction system to provide an air-fuel mixture to the engine 10.

The float bowl 14 on the top carburetor 11 acts as a fuel reservoir for the enrichment system and is connected by a fuel line 16 to the T-connection 17 on top of carburetor 12. From the T-connection 17 fuel line 18 is connected to the fitting 19 on top of the bottom carburetor 13. Both carburetors 12 and 13 have identical drilled passages 20 connecting their barrels 15 to the fittings 17 and 19 respectively. The passages 20 enter the carburetor barrels 15 near their discharge side to assure the flow of fuel into the engine. To control the flow of fuel from the float bowl 14 of the upper carburetor 11 to the lower carburetors 12 and 13, a valve 21 is provided in the fuel line 16. In the preferred embodiment the valve 21 is a normally closed orifice type solenoid valve having a manual override.

To operate the cold start fuel enrichment system, the operator opens valve 21, either by electrical means or by its manual override. Fuel from the float bowl 14 of the upper carburetor will then run down, by gravity, through fuel lines 16 and 18 to fittings 17 and 19, through passages 20, and into the throttle bores 15 of carburetors 12 and 13, preferably on the engine side of the carburetors. Fitting 19 has a built in restriction or orifice to balance the flow between the two carburetors 12 and 13. The system can be operated prior to cranking the engine 10 to provide prepriming or it can be operated during cranking. In either event, highly reliable priming of the engine 10 is assured. In the preferred embodiment the carburetor float bowls 14 are sized just small enough to prevent flooding of the engine when the float bowl 14 of the upper carburetor is completely drained during the pre-priming operation.

As is readily apparent, the inventors have provided a highly reliable fuel enrichment system for cold starting of engines. The system adds no impedance to the carburetor air stream ahead of the carburetor and eliminates the need for complicated mechanical linkages. Flooding is virtually eliminated by proper sizing of the float bowl 14. The system is particularly well adapted for use in multi cylinder outboard motor engines where the use of a vertical crankshaft engine results in the placement of carburetors in vertical rows, though the invention could be used in an engine having other orientations.

We claim:

1. A cold start fuel enrichment system for a multi-cylinder internal combustion engine comprising:

A. a plurality of independently operable engine air induction passages each for a different cylinder, each induction passage at a different height on said engine, and each of said induction passages including a carburetor;

B. a fuel passageway connecting the float bowl of the highest of said carburetors to a lower one of said induction passages at a point below said highest float bowl; and C. a valve means for controlling the flow of fuel through said fuel passageway, whereby fuel can be directed to flow by gravity into said lower induction passage from said highest float bowl to provide fuel to the lower cylinders of said engine for starting said engine.

2. The system defined in claim 1 wherein said valve means is a solenoid valve.

3. A cold start fuel enrichment system for a multi-cylinder internal combustion engine comprising:

A. a plurality of carburetors mounted at different heights on an induction manifold of said engine, each of said carburetors supplying air fuel mixture to different cylinders of said engine by way of induction passages through said manifold and said carburetors, and B. a fuel passageway between the float bowl of the highest of said carburetors and a first lower induction passage;

whereby the float bowl of said highest carburetor may be drained by gravity to supply primer fuel to said first lower induction passage prior to and for starting said engine.

4. The system defined in claim 3 wherein said fuel passageways include a valve for controlling the flow of fuel through said passageways.

5. The system defined in claim 4 further comprising a second lower induction passage and said fuel passageway is further connected to said second induction passage to receive primer fuel simultaneously with said first lower induction passage.

6. The system defined in claim 5 wherein said fuel passageway includes a T-connection to said second lower induction passage.

7. The system defined in claim 5 wherein an orifice is provided in said fuel passageway between said first and second lower induction passages to assure equal distribution of fuel to said first and second lower induction passages.

8. The system defined in claim 7 wherein said carburetors each have two air induction tubes.

9. The system defined in claim 8 wherein said fuel passageway connects to both of said air induction tubes of said first and second carburetors.

10. The system defined in claim 9 wherein said fuel passageway enters each of said air induction tubes near their discharge side.

* * * * *